US009451358B2

(12) United States Patent
Sridharan et al.

(10) Patent No.: US 9,451,358 B2
(45) Date of Patent: Sep. 20, 2016

(54) SYSTEM AND METHOD FOR ADJUSTING MICROPHONE FUNCTIONALITY

(71) Applicant: Robert Bosch GmbH, Stuttgart (DE)

(72) Inventors: Sucheendran Sridharan, McMurray, PA (US); Eric Bauer, San Jose, CA (US); Mikko Suvanto, Pittsburgh, PA (US)

(73) Assignee: Robert Bosch GmbH, Stuttgart (DE)

( * ) Notice: Subject to any disclaimer, the term of this patent is extended or adjusted under 35 U.S.C. 154(b) by 75 days.

(21) Appl. No.: 14/496,678

(22) Filed: Sep. 25, 2014

(65) Prior Publication Data

US 2015/0086043 A1 Mar. 26, 2015

Related U.S. Application Data

(60) Provisional application No. 61/882,125, filed on Sep. 25, 2013, provisional application No. 62/033,857, filed on Aug. 6, 2014.

(51) Int. Cl.
*H04R 3/00* (2006.01)
*H04R 29/00* (2006.01)

(52) U.S. Cl.
CPC ..... *H04R 3/00* (2013.01); *H04R 29/004* (2013.01)

(58) Field of Classification Search
CPC ..... H04R 3/00
USPC ..... 381/111–115, 122
See application file for complete search history.

(56) References Cited

U.S. PATENT DOCUMENTS 6,047,073 A * 4/2000 Norris ..... G10H 1/0066 381/61
8,284,958 B2 10/2012 Suvanto et al.
2007/0237343 A1* 10/2007 Schobben ..... H04R 3/04 381/111
2013/0287231 A1* 10/2013 Kropfitsch ..... H02M 3/073 381/113

* cited by examiner

*Primary Examiner* — Paul S Kim
*Assistant Examiner* — Katherine Faley
(74) *Attorney, Agent, or Firm* — Michael Best & Friedrich LLP

(57) ABSTRACT

An adjustable microphone. The microphone includes a MEMS microphone, a charge pump, a preamplifier, a first analog-to-digital converter, a root mean square (RMS) power detector, and a logic circuit. The MEMS microphone is configured to provide a signal indicative of sound detected by the MEMS microphone. The charge pump provides a bias voltage to the MEMS microphone. The preamplifier receives the signal from the MEMS microphone, and outputs an amplified signal indicative of sound detected by the MEMS microphone. The first analog-to-digital converter receives the amplified signal and converts the amplified signal to a digital signal. The root mean square power detector is configured to detect a power level of the amplified signal and output an indication of the power of the amplified signal. The logic circuit receives the RMS power detector output and a control input, and adjusts the operation of the microphone based on the control input.

20 Claims, 4 Drawing Sheets

SYSTEM AND METHOD FOR ADJUSTING MICROPHONE FUNCTIONALITY

RELATED APPLICATIONS

The present patent application claims the benefit of prior filed U.S. Provisional Patent Application Nos. 61/882,125, filed on Sep. 25, 2013, and 62/033,857, filed Aug. 6, 2014, the entire content of each is hereby incorporated by reference.

BACKGROUND

The present invention relates to a digital microphone that operates in one of a plurality of power modes based on an input signal.

SUMMARY

In certain embodiments, the invention provides an adjustable digital microphone whose operation is adjusted based on a frequency of a clock signal.

In one embodiment, the invention provides an adjustable microphone. The microphone includes a MEMS microphone, a charge pump, a preamplifier, a first analog-to-digital converter, a root mean square (RMS) power detector, and a logic circuit. The MEMS microphone is configured to provide a signal indicative of sound detected by the MEMS microphone. The charge pump provides a bias voltage to the MEMS microphone. The preamplifier receives the signal from the MEMS microphone, and outputs an amplified signal indicative of sound detected by the MEMS microphone. The first analog-to-digital converter receives the amplified signal and converts the amplified signal to a digital signal. The root mean square power detector is configured to detect a power level of the amplified signal and output an indication of the power of the amplified signal. The logic circuit receives the RMS power detector output and a control input, and adjusts the operation of the microphone based on the control input.

Other aspects of the invention will become apparent by consideration of the detailed description and accompanying drawings.

DETAILED DESCRIPTION

Figure 1:
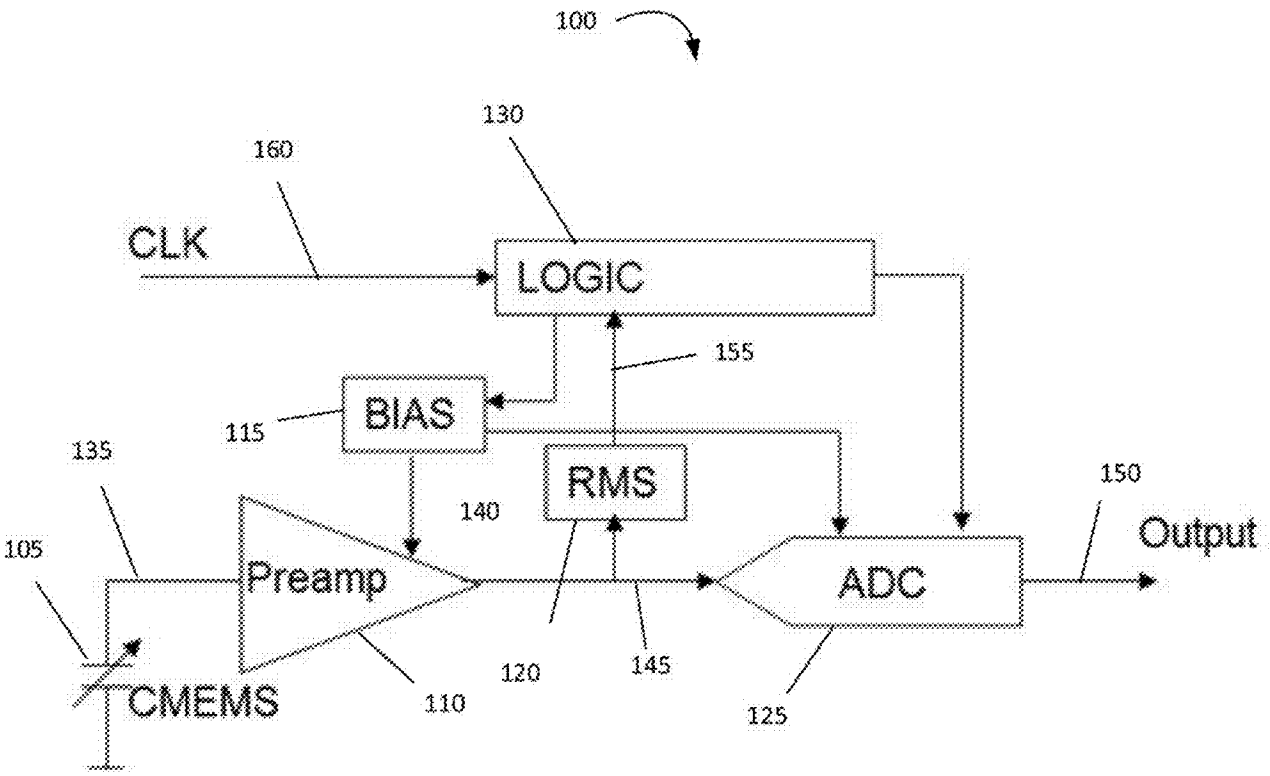
FIG. 1 is a block diagram of an exemplary digital microphone.

FIG. 1 shows a construction of a digital microphone 100. The microphone 100 includes a MEMS microphone 105, a preamplifier 110, a bias source 115, an analog signal detector (e.g., a root mean square "RMS" power detector) 120, an analog-to-digital converter (ADC) 125, and a logic circuit 130. The MEMS microphone 105 detects an acoustic signal and outputs an analog signal 135 indicative of the detected acoustic signal. The preamplifier 110 receives the analog signal 135 output by the MEMS microphone 105, and, based on a bias signal 140 received from the bias source 115, outputs an amplified version of the analog signal 145. The ADC 125 receives the amplified analog signal 145 and converts it to a digital signal 150. The analog signal detector 120 monitors the amplified analog signal 145 and generates an output 155 indicative of the RMS power of the amplified analog signal 145. The logic circuit 130 receives an input signal 160 and the output 155 of the analog signal detector 120, and controls the bias source 115 and the ADC 125 based on the input signal 160 and the output 155 of the analog signal detector 120. The bias source 115 also provides a bias to the ADC 125.

In the embodiment shown in FIG. 1, the input signal 160 is a clock signal. The microphone 100 detects the clock frequency and, based on a detected frequency range, adjusts the analog and digital performance of the microphone 100.

The microphone 100 can be used in digital microphone platforms (e.g., digital recording devices, cell phones, tablet computers, etc.) to reduce overall power consumption.

The clock 160 can be supplied to the microphone 100 from a "codec" or a processor in the host device (e.g., the tablet computer). It should be understood that the microphone and codec may both be located within the host device. The input clock signal 160 is monitored and the functionality of the microphone is changed based on the detected frequency of the clock 160 as described in FIG. 2. The digital output stream 150 is processed in the "codec" as before, but since the "codec" is aware of the clock signal 160 it supplied to the microphone 100, it can process the data accurately in various modes.

Figure 2:
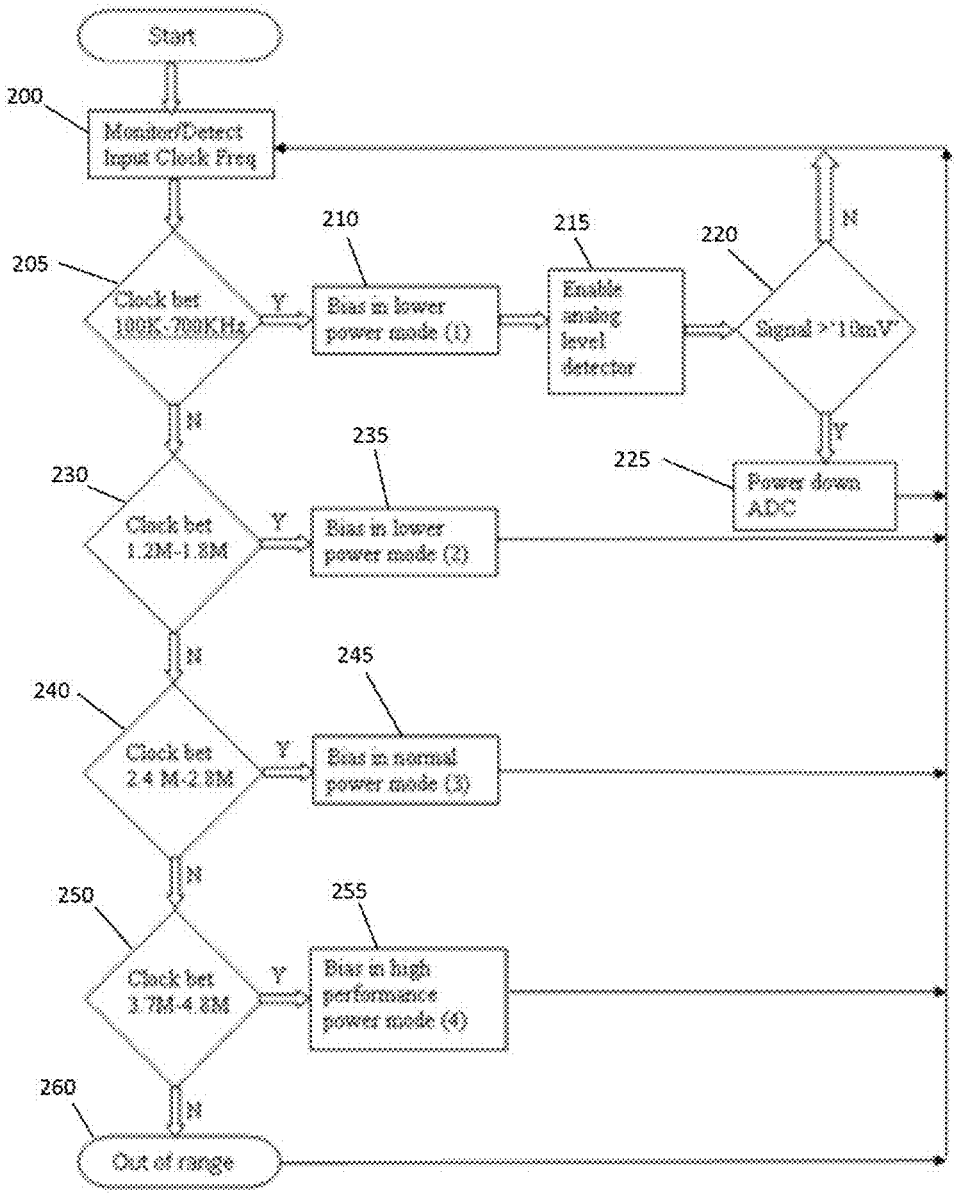
FIG. 2 is a flow chart of the operation of the digital microphone of FIG. 1.

FIG. 2 shows the operation of the microphone 100. The logic circuit 130 monitors the frequency of the input signal 160 (step 200). If the frequency is within a first range (e.g., 100-700 kHz) (step 205), the logic circuit 130 controls the bias source 115 in a low power mode (step 210) and checks the output 155 of the analog signal detector 120 (steps 215 and 220). If the amplified analog signal 145 is above a threshold (e.g., 10 mV), the logic circuit 130 shuts down the ADC 125 (step 225). If the amplified analog signal is less than the threshold (step 220), the logic circuit 130 continues to monitor the clock signal 160 (step 200).

If the clock signal 160 is within a second range (e.g., 1.2-1.8 mHz) (step 230), the logic circuit 130 controls the bias source 115 in a second low power mode (step 235), and continues to monitor the clock signal 160 (step 200). If the clock signal 160 is within a third range (e.g., 2.4-2.8 mHz) (step 240), the logic circuit 130 controls the bias source 115 in a normal power mode (step 245), and continues to monitor the clock signal 160 (step 200). If the clock signal 160 is within a fourth range (e.g., 3.7-4.8 mHz) (step 250), the logic circuit 130 controls the bias source 115 in a high power mode (step 255), and continues to monitor the clock signal 160 (step 200). If the clock signal 160 in not within any of the ranges (step 260), the logic circuit 130 makes no change to the bias and continues to monitor the clock signal 160 (step 200).

Figure 3:
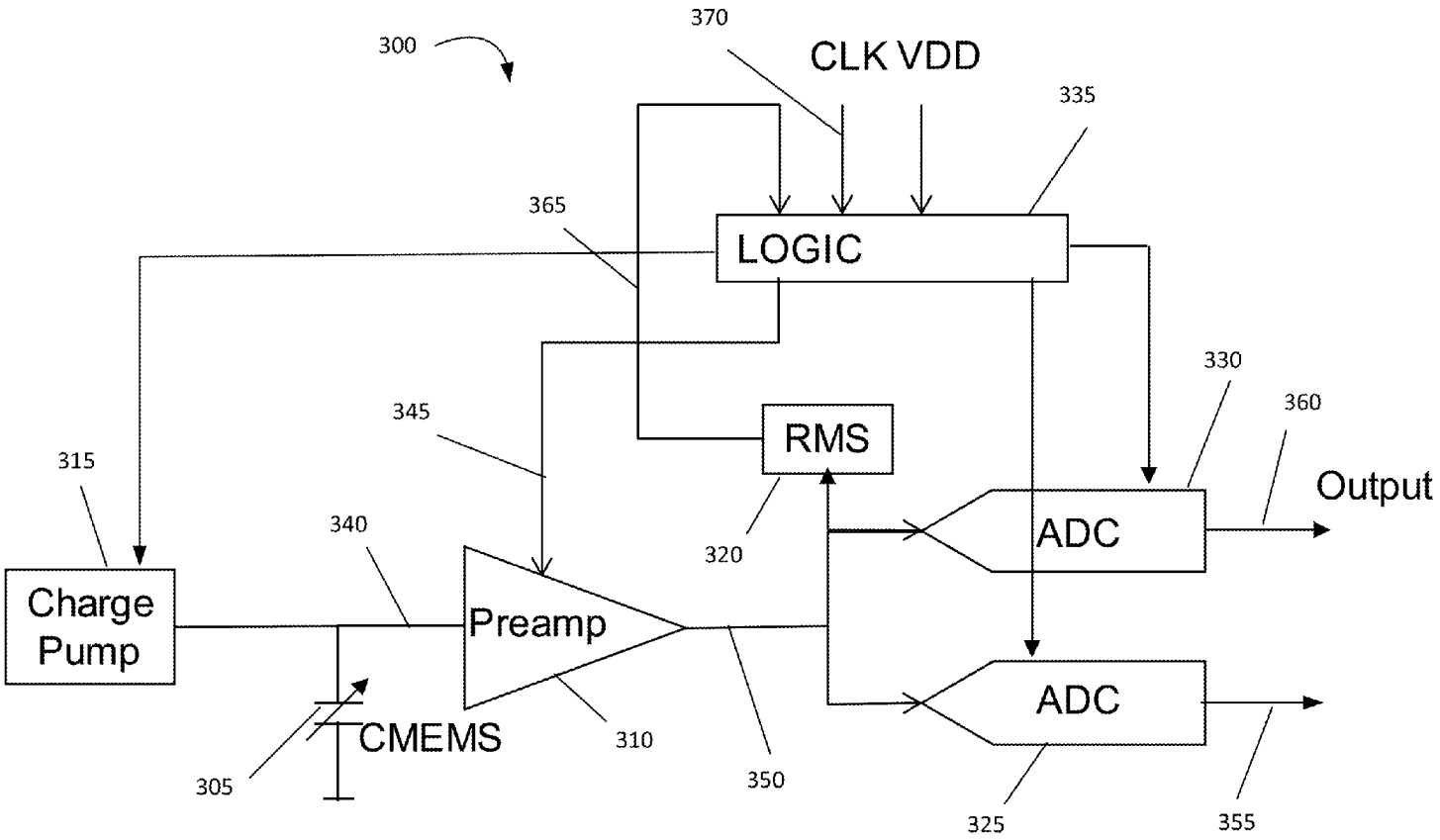
FIG. 3 is a block diagram of another embodiment of a digital microphone
Figure 4:
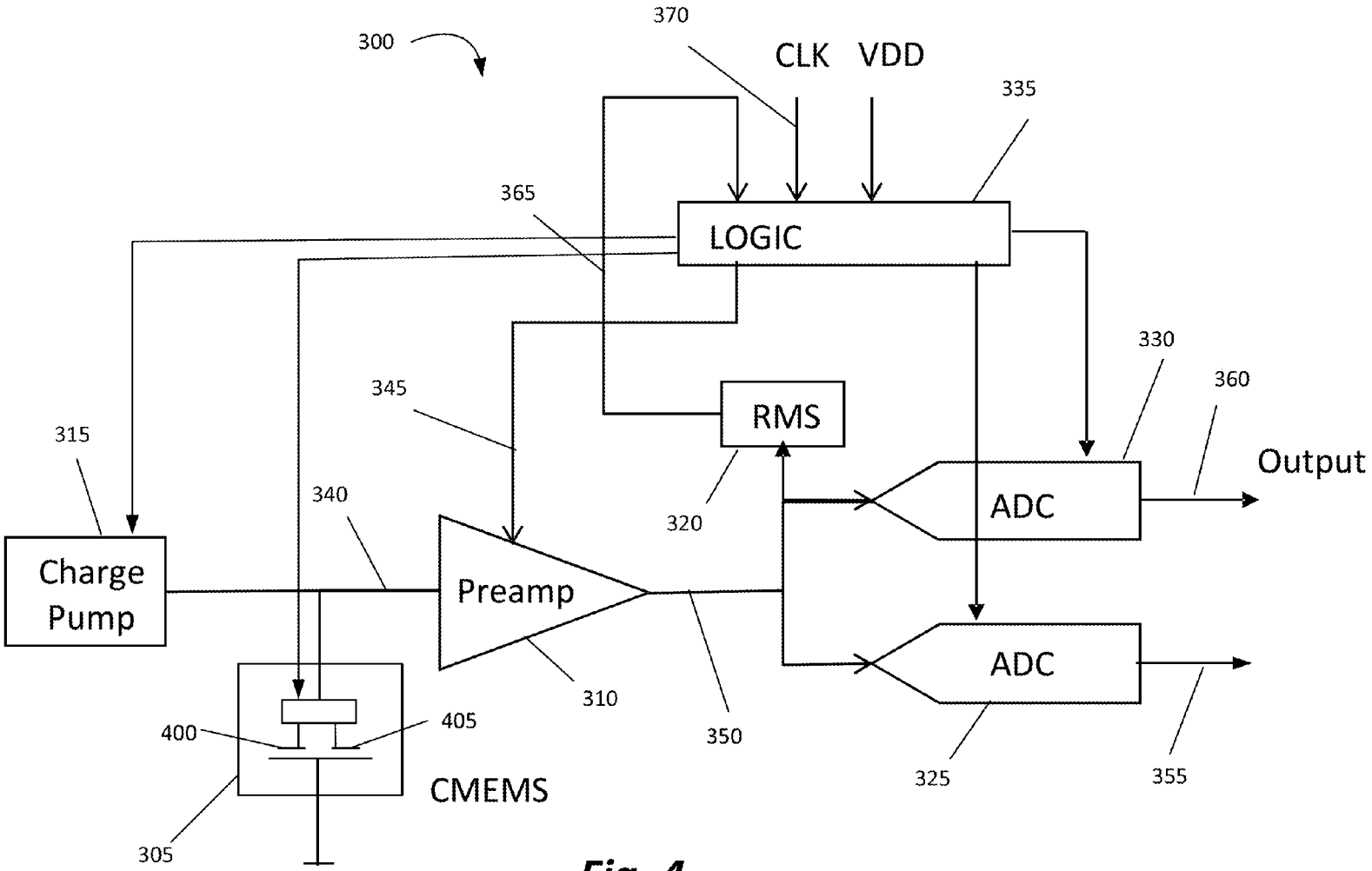
FIG. 4 is a block diagram of another embodiment of a digital microphone

FIG. 3 shows a construction of a digital microphone 300. The microphone 300 includes a MEMS microphone 305, a preamplifier 310, a charge pump 315, an analog signal detector (e.g., a root mean square "RMS" power detector) 320, a first analog-to-digital converter (ADC) 325, a second ADC 330, and a logic circuit 335. The MEMS microphone 305 detects an acoustic signal and outputs an analog signal 340 indicative of the detected acoustic signal. The preamplifier 310 receives the analog signal 340 output by the MEMS microphone 305, and, based on a bias signal 345 received from the logic circuit 335, outputs an amplified version of the analog signal 350. The first ADC 325 receives the amplified analog signal 350 and converts it to a digital signal 355. The second ADC 330 receives the amplified analog signal 350 and converts it to a digital signal 360. In some embodiments, the digital signals 355 and 360 are coupled to a single output pin. The analog signal detector 320 monitors the amplified analog signal 350 and generates an output 365 indicative of the RMS power of the amplified analog signal 350. The logic circuit 335 receives an input signal 370 and the output 360 of the analog signal detector 320, and controls a bias of the MEMS microphone 305 and the first and second ADCs 325 and 330 based on the input signal 370 and the output 360 of the analog signal detector 320.

In some embodiments, the input signal 370 is a clock signal. The microphone 300 detects the clock frequency and, based on a detected frequency range, adjusts the analog and digital performance of the microphone 300. In other embodiments alternative input signals are used (e.g., the voltage level of VDD).

The microphone 300 can be used in digital microphone platforms (e.g., digital recording devices, cell phones, tablet computers, etc.) to reduce overall power consumption.

The input signal 370 can be supplied to the microphone 300 from a "codec" or a processor in the host device (e.g., the tablet computer). It should be understood that the microphone and codec may both be located within the host device. The input signal 370 is monitored and the functionality of the microphone is changed based on the detected input signal 370. The digital output streams 355 and 360 are processed in the "codec" as before, but since the "codec" is aware of the input signal 370 it supplied to the microphone 300, it can process the data accurately in various modes.

In some embodiments, the first ADC 325 is a high performance, high power ADC, the second ADC 330 is a lower performance, lower power ADC. Based on the input signal 370, the logic circuit 335 uses one of the first and second ADCs 325 and 330. For example, when the input signal 370 indicates the microphone 300 should operate in a low power mode, the logic circuit 335 uses the second ADC 330. Alternatively, when the input signal 370 calls for high performance, the logic circuit 335 uses the first ADC 325. In addition, the logic circuit 335 can also shut down both the first and second ADCs 325 and 330 until activity is detected (e.g., by analog RMS level detection).

In another embodiment, the microphone 300 includes a third ADC (e.g., for an ultrasonic mode).

In some embodiments, the logic circuit 335 changes the gain of the preamp 310 based on the input signal 370 to adjust the power/performance of the microphone 300. In some embodiments, the logic circuit 335 changes the charge pump 315 voltage based on the input signal 370 to adjust the power/performance of the microphone 300.

In some embodiments, the MEMS microphone 305 includes a pair of membranes 400 and 405. The logic circuit 335 can, based on the input signal 370, disable one of the membranes and alter the bias or gain settings for the other of the membrane to adjust the power/performance characteristics of the microphone 300.

In another embodiment, the microphone 300 includes an additional pin that outputs analog data in selected modes.

Thus, the invention provides, among other things, an adjustable digital microphone. Among other potential advantages, by using an input signal from a codec or a processor of the host device to control the microphone, there is no need for a more complicated or additional communication link between the two in order for the codec or processor to control the microphone.

What is claimed is:

1. An adjustable microphone, the microphone comprising:

a MEMS microphone configured to provide a signal indicative of sound detected by the MEMS microphone;

a charge pump coupled to the MEMS microphone and providing a bias voltage to the MEMS microphone;

a preamplifier coupled to the MEMS microphone and receiving the signal from the MEMS microphone, the preamplifier outputting an amplified signal indicative of sound detected by the MEMS microphone;

a first analog-to-digital converter (ADC) receiving the amplified signal and converting the amplified signal to a digital signal;

a root mean square (RMS) power detector configured to detect a power level of the amplified signal and output an indication of the power of the amplified signal; and a logic circuit receiving the RMS power detector output and a control input, the logic circuit adjusting the operation of the microphone based on the control input;

wherein the logic circuit adjusts an amplification of the preamplifier based on the control input and the RMS power detector output.

2. The microphone of claim 1, wherein the logic circuit adjusts the bias voltage provided to the MEMS microphone based on the control input and the RMS power detector output.

3. The microphone of claim 1, further comprising a second ADC, the first ADC being a high-performance ADC and the second ADC being a lower-performance ADC.

4. The microphone of claim 3, wherein the logic circuit selects one of the first ADC and the second ADC to provide a microphone output based on the control input and the RMS power detector output.

5. The microphone of claim 3, further comprising a third ADC, the third ADC being an ultrasonic ADC.

6. The microphone of claim 5, wherein the logic circuit selects one of the first ADC, the second ADC, and the third ADC to provide a microphone output based on the control input and the RMS power detector output.

7. The microphone of claim 1, wherein the MEMS microphone includes a first membrane and a second membrane, wherein the logic circuit selects, based on the control input and the RMS power detector output, one or both of the first and second membranes to provide the signal indicative of sound detected by the MEMS microphone.

8. An adjustable microphone, the microphone comprising:

a MEMS microphone configured to provide a signal indicative of sound detected by the MEMS microphone;

a charge pump coupled to the MEMS microphone and providing a bias voltage to the MEMS microphone;

a preamplifier coupled to the MEMS microphone and receiving the signal from the MEMS microphone, the preamplifier outputting an amplified signal indicative of sound detected by the MEMS microphone;

a first analog-to-digital converter (ADC) receiving the amplified signal and converting the amplified signal to a digital signal, the first ADC being a high-performance ADC;

a second analog-to-digital converter (ADC) receiving the amplified signal and converting the amplified signal to a digital signal, the second ADC being a lower-performance ADC;

a root mean square (RMS) power detector configured to detect a power level of the amplified signal and output an indication of the power of the amplified signal; and a logic circuit receiving the RMS power detector output and a control input, the logic circuit adjusting operation of the microphone based on the control input.

9. The microphone of claim 8, wherein the logic circuit adjusts the bias voltage provided to the MEMS microphone based on the control input and the RMS power detector output.

10. The microphone of claim 8, wherein the logic circuit adjusts an amplification of the preamplifier based on the control input and the RMS power detector output.

11. The microphone of claim 8, wherein the logic circuit selects one of the first ADC and the second ADC to provide a microphone output based on the control input and the RMS power detector output.

12. The microphone of claim 8, further comprising a third ADC, the third ADC being an ultrasonic ADC.

13. The microphone of claim 12, wherein the logic circuit selects one of the first ADC, the second ADC, and the third ADC to provide a microphone output based on the control input and the RMS power detector output.

14. The microphone of claim 8, wherein the MEMS microphone includes a first membrane and a second membrane, wherein the logic circuit selects, based on the control input and the RMS power detector output, one or both of the first and second membranes to provide the signal indicative of sound detected by the MEMS microphone.

15. An adjustable microphone, the microphone comprising:

a MEMS microphone, including a first membrane and a second membrane, configured to provide a signal indicative of sound detected by the MEMS microphone;

a charge pump coupled to the MEMS microphone and providing a bias voltage to the MEMS microphone;

a preamplifier coupled to the MEMS microphone and receiving the signal from the MEMS microphone, the preamplifier outputting an amplified signal indicative of sound detected by the MEMS microphone;

a first analog-to-digital converter (ADC) receiving the amplified signal and converting the amplified signal to a digital signal;

a root mean square (RMS) power detector configured to detect a power level of the amplified signal and output an indication of the power of the amplified signal; and a logic circuit receiving the RMS power detector output and a control input, the logic circuit adjusting operation of the microphone based on the control input;

wherein the logic circuit selects, based on the control input and the RMS power detector output, one or both of the first and second membranes to provide the signal indicative of sound detected by the MEMS microphone.

16. The microphone of claim 15, wherein the logic circuit adjusts the bias voltage provided to the MEMS microphone based on the control input and the RMS power detector output.

17. The microphone of claim 15, wherein the logic circuit adjusts an amplification of the preamplifier based on the control input and the RMS power detector output.

18. The microphone of claim 15, further comprising a second ADC, the first ADC being a high-performance ADC and the second ADC being a lower-performance ADC.

19. The microphone of claim 18, wherein the logic circuit selects one of the first ADC and the second ADC to provide a microphone output based on the control input and the RMS power detector output.

20. The microphone of claim 18, further comprising a third ADC, the third ADC being an ultrasonic ADC, wherein the logic circuit selects one of the first ADC, the second ADC, and the third ADC to provide a microphone output based on the control input and the RMS power detector output.

* * * * *